US010337692B2

(12) United States Patent
Jurik et al.

(10) Patent No.: US 10,337,692 B2
(45) Date of Patent: Jul. 2, 2019

(54) SYSTEM AND METHOD FOR PREVENTING LIGHT SPILL

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 88 days.

(21) Appl. No.: 15/264,620

(22) Filed: Sep. 14, 2016

(65) Prior Publication Data

US 2018/0073692 A1 Mar. 15, 2018

(51) Int. Cl.

| | |
|---|---|
| ***F21S 2/00*** | (2016.01) |
| ***F21V 5/00*** | (2018.01) |
| ***F21V 5/04*** | (2006.01) |
| ***F21V 11/06*** | (2006.01) |
| ***F21Y 113/17*** | (2016.01) |
| ***F21Y 115/10*** | (2016.01) |
| ***F21W 131/406*** | (2006.01) |

(52) U.S. Cl.

CPC ..... *F21V 5/007* (2013.01); *F21V 5/04* (2013.01); *F21V 5/048* (2013.01); *F21V 11/06* (2013.01); *F21S 2/00* (2013.01); *F21W 2131/406* (2013.01); *F21Y 2113/17* (2016.08); *F21Y 2115/10* (2016.08)

(58) Field of Classification Search

CPC ..... F21V 5/007; F21W 2131/406

See application file for complete search history.

(56) References Cited

U.S. PATENT DOCUMENTS

| | | | | |
|---|---|---|---|---|
| 9,261,269 | B2 | 2/2016 | Jurik et al. | |
| 2012/0134151 | A1* | 5/2012 | Jurik | F21V 5/008 362/235 |
| 2015/0092418 | A1 | 4/2015 | Jurik et al. | |
| 2016/0018064 | A1 | 1/2016 | Jurik et al. | |
| 2016/0123541 | A1* | 5/2016 | Quilici | F21K 9/233 315/210 |
| 2016/0178165 | A1* | 6/2016 | Quadri | F21V 14/02 362/232 |

* cited by examiner

*Primary Examiner* — Anh T Mai
*Assistant Examiner* — Zachary J Snyder
(74) *Attorney, Agent, or Firm* — Conley Rose, P.C.; Grant Rodolph; Brooks W Taylor

(57) ABSTRACT

Described is a light engine comprised of an array of light engine modules which are compartmentalized to minimize light spill from one light engine module to other light engine modules.

11 Claims, 8 Drawing Sheets

SYSTEM AND METHOD FOR PREVENTING LIGHT SPILL

TECHNICAL FIELD OF THE DISCLOSURE

The present disclosure generally relates to a method for providing a luminaire, specifically to optical systems and a method for preventing light spill between adjacent light sources within the luminaire.

BACKGROUND OF THE DISCLOSURE

Luminaires with automated and remotely controllable functionality are well known in the entertainment and architectural lighting markets. Such products are commonly used in theatres, television studios, concerts, theme parks, night clubs, and other venues. A typical product will provide control over the functions of the luminaire allowing the operator to control the intensity and color of the light beam from the luminaire that is shining on the stage or in the studio. Many products also provide control over other parameters such as the position, focus, beam size, beam shape, and beam pattern. In such products that contain light emitting diodes (LEDs) to produce the light output it is common to use more than one color of LEDs and to be able to adjust the intensity of each color separately such that the output, which comprises the combined mixed output of all LEDs, can be adjusted in color. For example, such a product may use red, green, blue, and white LEDs with separate intensity controls for each of the four types of LED. This allows the user to mix almost limitless combinations and to produce nearly any color they desire.

FIG. 1 illustrates a typical multiparameter automated luminaire system 10. These systems typically include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each automated luminaire 12 is connected in series or in parallel to data link 14 to one or more control desks 15. The automated luminaire system 10 is typically controlled by an operator through the control desk 15.

Luminaires have been provided using non-LED light sources designed to produce a single narrow beam or a plurality of such beams. Such luminaires may use low etendue, High Intensity Discharge (HID) light sources with a small arc gap in order to facilitate the production of tight, almost parallel light beams. U.S. patent application Ser. Nos. 14/042,758 and 14/042,759 provide examples of such a system. Single and multi-color LED sourced luminaires have also been produced with narrow beam capability using sophisticated collimation systems as, for example, disclosed in U.S. patent application Ser. No. 14/405,355. LEDs however are high etendue light sources by comparison with HID and it is difficult to produce multiple separated beam systems using LED light sources.

Prior art optical systems utilizing multiple LED emitters designed to be run independently as separate light modules within a single luminaire frequently suffer from light spill from one light module to the adjacent light module. This light spill contaminates the effect and clarity of each of the independent light modules and reduces the effectiveness of the luminaire for both the user and the viewer. Independent light modules should be truly independent with minimal spill of light from one light module to adjacent light module(s). Prior art systems may use internal baffles or egg-crates to try and isolate the independent light sources, but still suffer from light spill or bleeding across adjacent light modules due to internal reflection, back reflection, refraction, or other light leakage path(s). These prior art systems may also reduce the performance of the luminaire by restricting the output apertures in an attempt to provide light isolation.

There is a need for a method for producing and controlling the light spill between adjacent modules from an LED sourced wash light luminaire producing multiple light beams.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the Figures, like numerals being used to refer to like and corresponding parts of the various drawings.

The present disclosure generally relates to a method for providing special effects in wash light luminaires, specifically to a method relating to providing controllable lighting effects from a luminaire with a wash light distribution with a large effective source and true blending output distribution.

Figure 2:
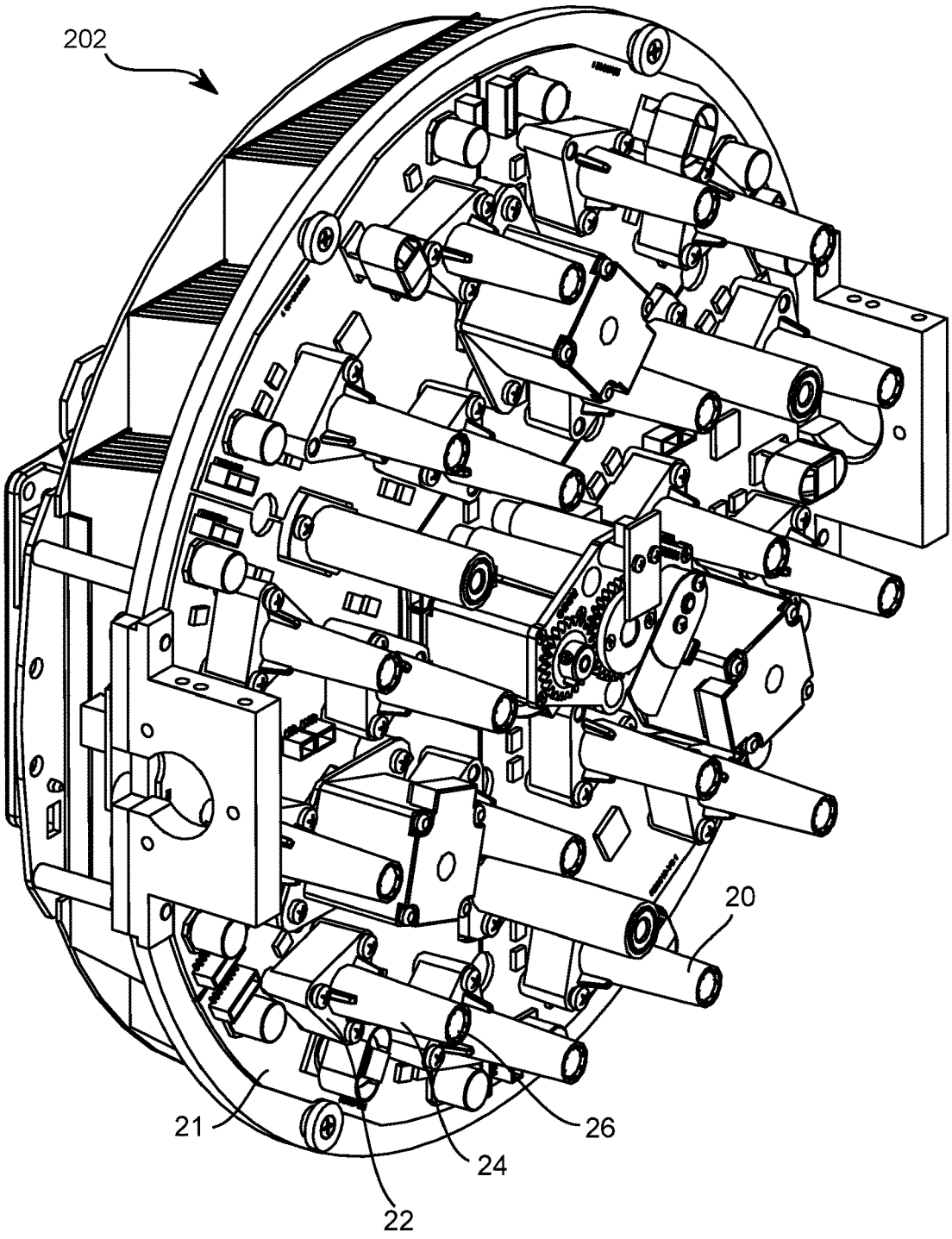
FIG. 2 illustrates the layout of an embodiment of the rear portion of a light engine of a luminaire generating multiple beam effects.

FIG. 2 illustrates the layout of an embodiment of the rear portion of a light engine 202 of a luminaire generating multiple beam effects. The light engine 202 consists of a plurality of separate light modules 20. Each light module 20 may comprise: a light isolating cover or enclosure 22 containing a light emitting component (such as an LED not shown), a protective sleeve 24, protecting a light guide optic (not shown) with an exit aperture 26. The light emitting component (not shown) may comprise a single LED or an array of LEDs, which may include a primary optic (not shown). The light emitting component may contain a single color of LEDs or may contain multiple dies, each of which may be of common or differing colors. For example, in one embodiment the light emitting component may comprise one each of a Red, Green, Blue, and White LED. In further embodiments, the light emitting component may comprise a single LED chip or package. While in yet further embodiments, the light emitting component may comprise multiple LED chips or packages either under a single primary optic or each package with its own primary optic. In some embodiments these LED die(s) may be paired with optical lens element(s) as part of the LED light-emitting module. In a further embodiment, the light emitting component may comprise more than four colors of LEDs. For example, seven colors may be used, one each of a Red, Green, Blue, White, Amber, Cyan, and Deep Blue/UV LED die.

The light output from the LEDs in the light emitting component is contained or covered by a light isolating enclosure 22 and enters a light guide optic (not shown) contained within protective sleeve 24. The light guide optic may be a device utilizing internal reflection so as to collect, homogenize and constrain, and conduct the light to exit aperture 26. The light guide optic may be a hollow tube with a reflective inner surface such that light impinging into the entry port may be reflected multiple times along the tube before leaving at the exit aperture 26. The light guide optic may be a square tube, a hexagonal tube, a heptagonal tube, an octagonal tube, a circular tube, or a tube of any other cross section. In a further embodiment, the light guide optic may be a solid rod constructed of glass, transparent plastic or other optically transparent material where the reflection of the incident light beam within the rod is due to "total internal reflection" (TIR) from the interface between the material of the rod and the surrounding air. The integrating rod may be a square rod, a hexagonal rod, a heptagonal rod, an octagonal rod, a circular rod, or a rod of any other cross section. The light guide optic, whether solid or hollow, and with any number of sides, may have an entry port adjacent to the light emitting component and exit aperture 26 that differ in cross sectional shape. For example, a square entry port and an octagonal exit aperture 26. Further, the light guide optic may have sides which are tapered so that the entrance aperture is smaller than the exit aperture. The advantage of such a structure is that the divergence angle of light exiting the light guide optic at exit aperture 26 will be smaller than the divergence angle for light entering the guide. The combination of a smaller divergence angle from a larger aperture serves to conserve the etendue of the system. Thus, a tapered light guide optic may provide similar functionality to a condensing optical system.

Light isolating enclosure 22 along with protective sleeve 24 serve to prevent light spill from one light emitting component to any of the adjacent light emitting components.

Figure 3:
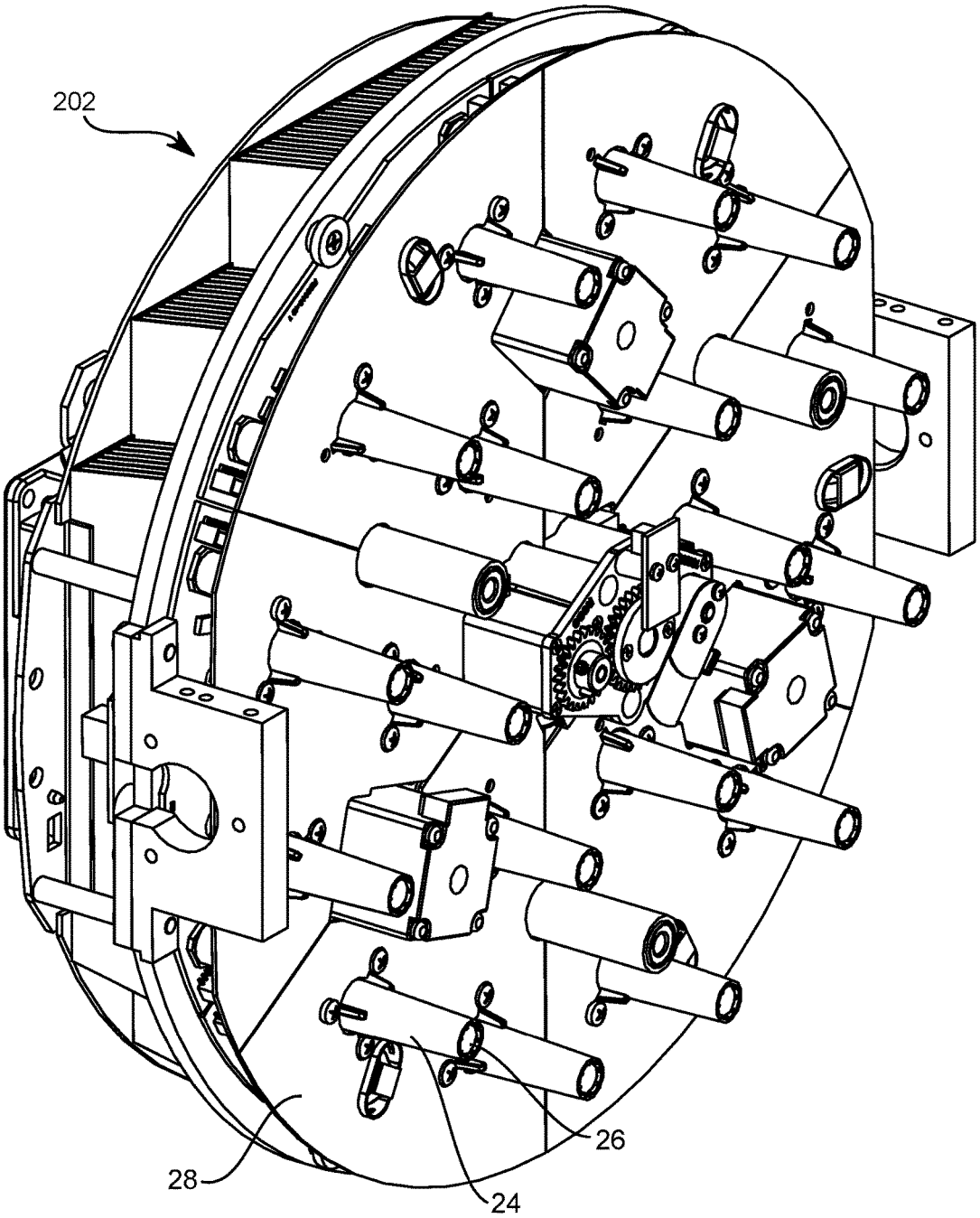
FIG. 3 illustrates an embodiment of the light engine illustrated in FIG. 2 fitted with a first light shield.

FIG. 3 illustrates an embodiment of the light engine 202 illustrated in FIG. 2 fitted with a first light shield 28. The light seal around the light cover or light isolating enclosure 22 in FIG. 2 may not be perfect and some light may escape around its edge. Accordingly, a first light shield 28 is added as an additional blocker for any stray or spill light. First light shield 28 may comprise a punched plate with apertures that fit snugly around protective sleeve 24. First light shield 28 may be painted black or treated with a non-reflective coating.

Figure 4:
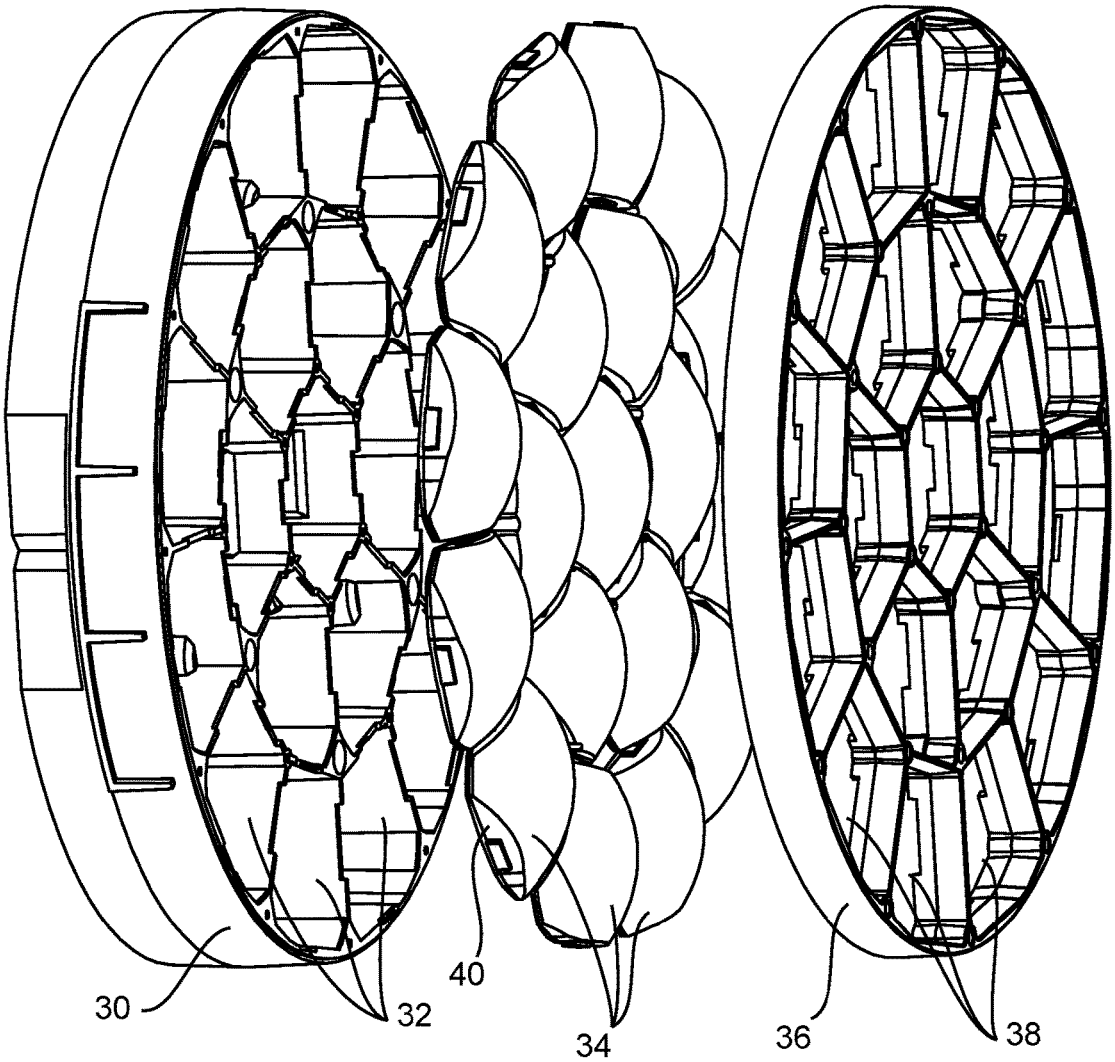
FIG. 4 illustrates an embodiment of a first baffle, lenses, and a second baffle of the light output portion of a luminaire generating multiple beam effects.

FIG. 4 illustrates an embodiment of a first baffle 30, lenses 34, and a second baffle 36 of the light output portion of a luminaire generating multiple beam effects. First baffle 30 comprises a plurality of separated and light shielded compartments 32, one compartment 32 for each LED module and its associated optics. The separate compartments 32 serve to further constrain light and prevent it spilling into adjacent modules. Lenses 34 are produced as separate lenses, rather than being molded from a single piece of glass or plastic, so as to maintain the individual light paths and prevent spill from one lens to an adjacent lens. After passing through lenses 34 the light passes through a second baffle 36 with light shielded compartments 38. First baffle 30 and second baffle 36 are advantageously manufactured or coated with a black or other anti-reflective coating. At this point each light module is combined with the light shielded compartments 32 and 38 and lenses 34 are paired with the light source enclosure and optics to form a light engine module, which together form an array of adjacent light engine modules or a light engine array.

Figure 5:
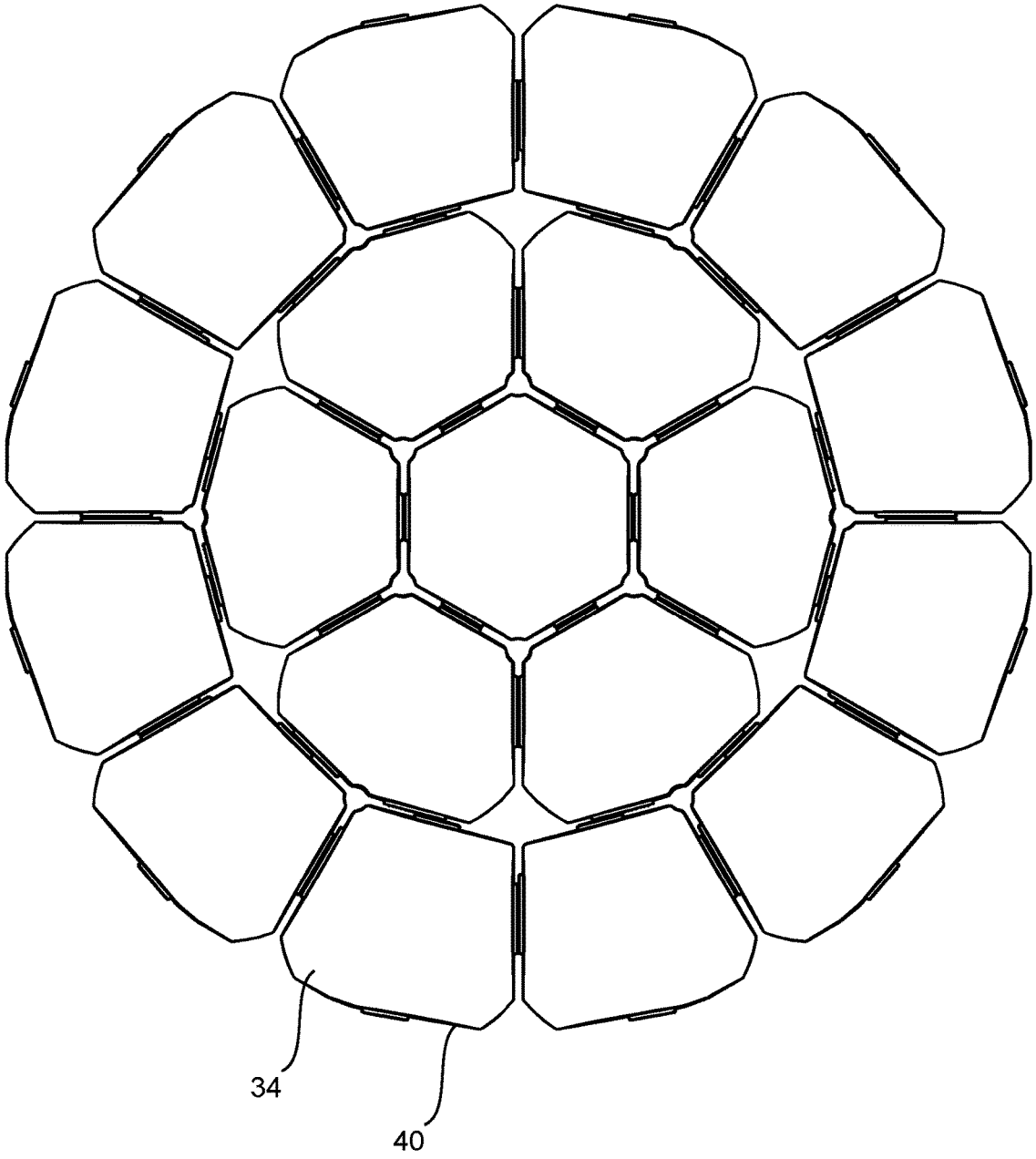
FIG. 5 illustrates a further view of an embodiment of the lenses.

FIG. 5 illustrates a further view of an embodiment of lenses 34. Each lens 34 in the array is separated from its neighbors and may have its edges 40 painted, printed, or otherwise coated with a black or other light absorbing coating. Treating the edges 40 of lenses 34 with a light absorbing coating prevents light that is internally reflected or refracted within lenses 34 from entering adjacent lenses as spill light. The system illustrated herein utilizes a single lens element. The disclosure is however not so limited, and further embodiments may contain different numbers and types of lenses or other optical systems as well known in the art. In particular, further embodiments may utilize systems where lenses 34 comprise multiple elements. In further embodiments lenses 34 may comprise a number of optical lens elements whose relationship to each other is not fixed and can alter. The elements of lenses 34 may be meniscus lenses, plano convex lenses, bi-convex lenses, holographic lenses, aspheric lenses, or other lenses as well known in the art. The elements of lens 34 may be constructed of glass, transparent plastic or other optically transparent material as known in the art.

In a preferred embodiment, lenses 34 comprises a single element constructed, by the use of aspheric surfaces or otherwise, to exhibit achromatic properties such that the colors in the light beam remain homogenized and do not produce objectionable colored fringing to the light beam.

Figure 6:
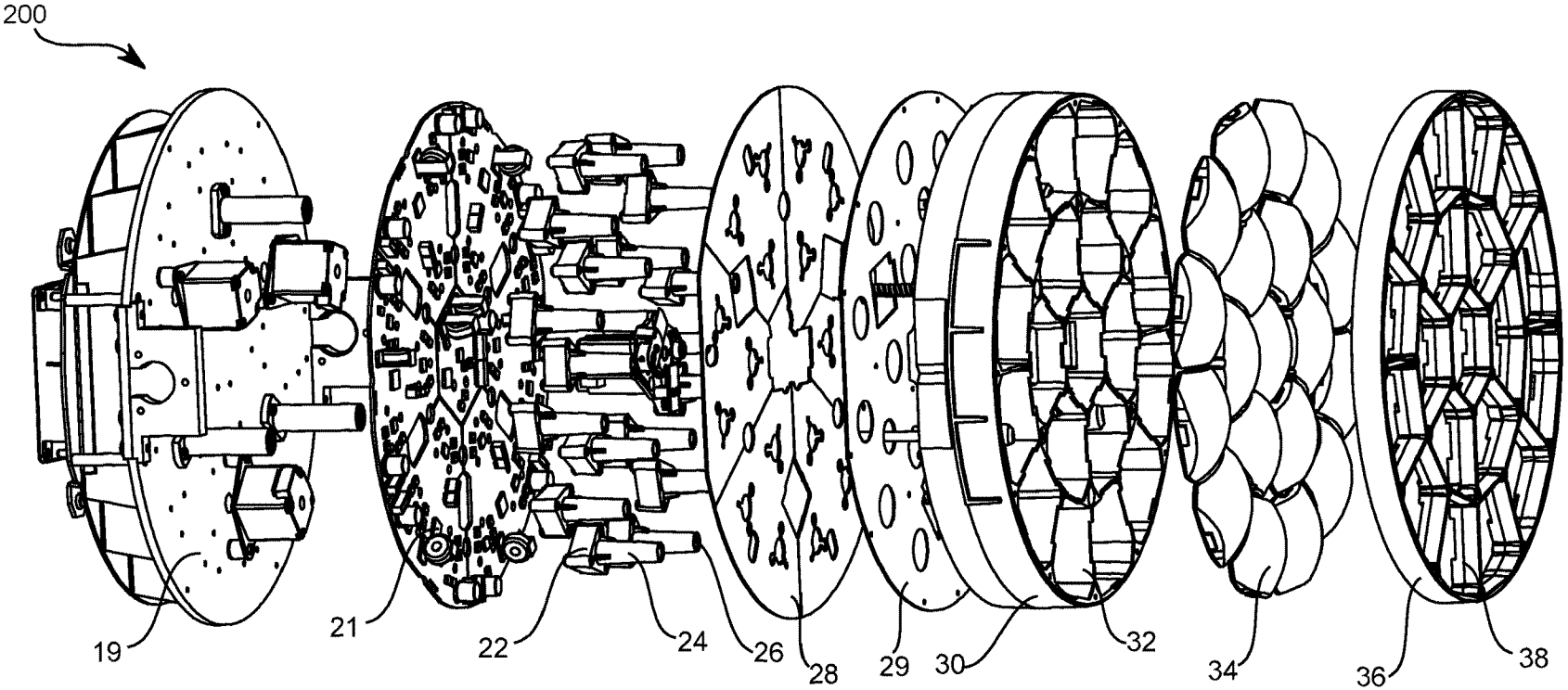
FIG. 6 illustrates an exploded front angled view of the light engine array and light spill prevention system of an embodiment of a luminaire generating multiple beam effects.
Figure 7:
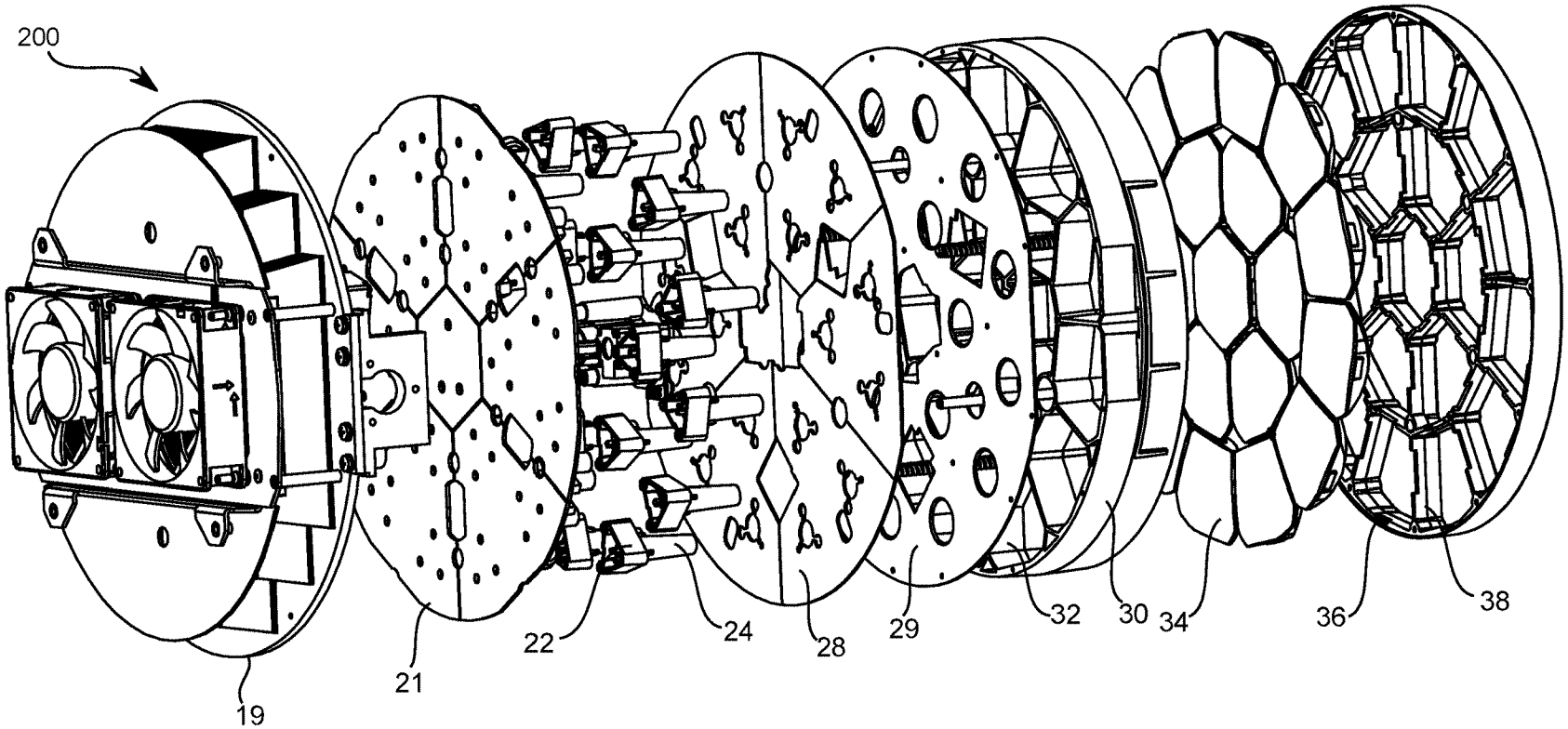
FIG. 7 illustrates a further exploded rear angled view of the light engine array and light spill prevention system of an embodiment of a luminaire generating multiple beam effects.

FIGS. 6 and 7 illustrate exploded views of the light engine array 200 with light spill prevention system of an embodiment of a luminaire generating multiple beam effects. They differ in that FIG. 6 illustrates a slightly front angled view into the light beam and FIG. 7 illustrates a slightly rear angled view along the light beam. The figures illustrate a back supporting structure 19. First mounted to the support structure is a Printed Circuit Board (PCB) 21 to which the light sources (not called out) are mounted. Next are the light isolating covers 22 with protective sleeves 24 with exit apertures 26. Next comes the first light shield 28 which will nest down low near the base of the protective sleeves 24. These figures also illustrate a second light shield 29 which may be fitted on the rear of first baffle 30. This second light shield 29 prevents light that may be reflected back from a lens 34 into a compartment 32 from further reflecting from first light shield 28 and spilling into adjacent compartments. An embodiment of a complete spill light prevention system may comprise; light isolating enclosure 22 along with protective sleeve 24, first light shield 28, second light shield 29, first baffle 30 with individual compartments 32, edge coated lenses 34, and second baffle 36 with individual compartments 38. The overall result is that the individual light engine modules are maintained as individual and separate beams such that each light module engine in the light engine array is distinct and separate to the viewer.

Figure 1:
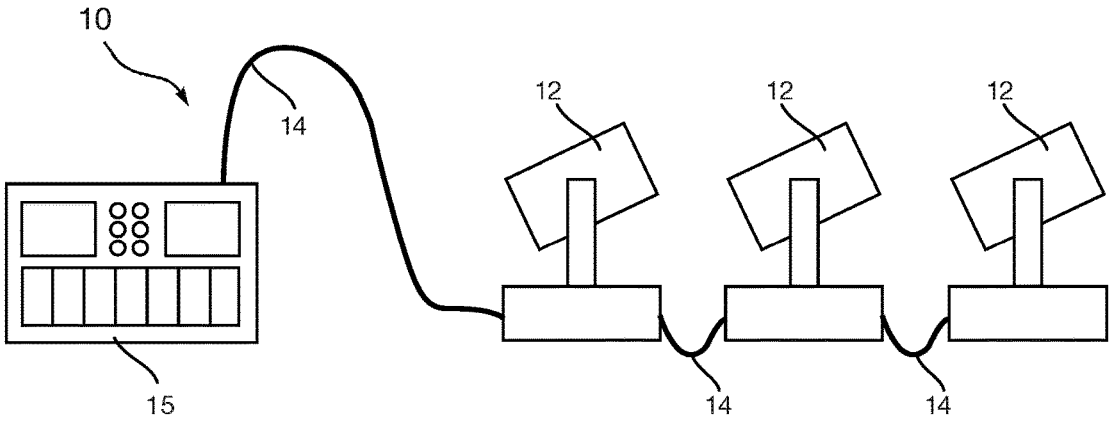
FIG. 1 illustrates a typical multiparameter automated luminaire system including luminaires as further described herein.
Figure 8:
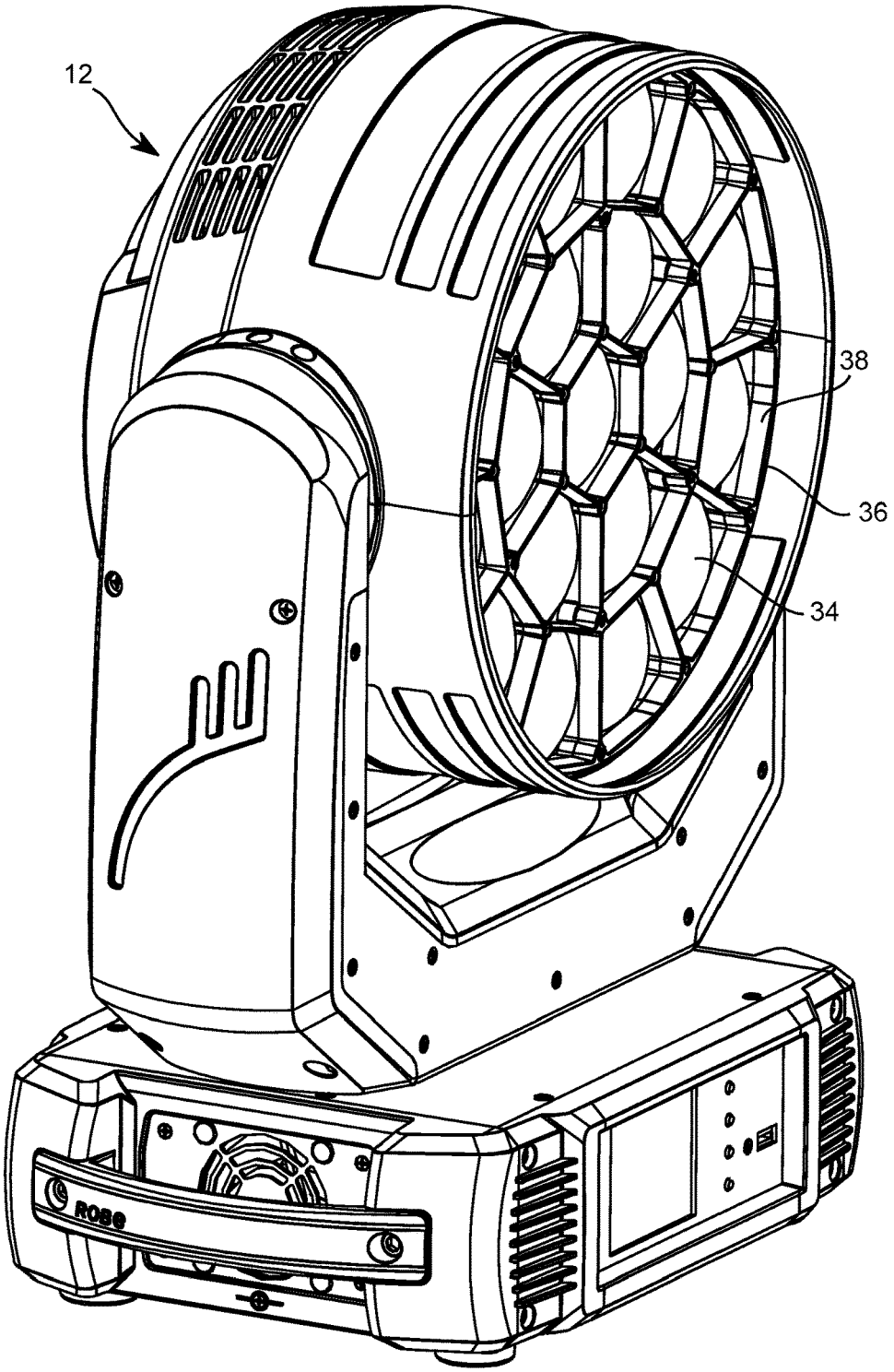
FIG. 8 illustrates a complete luminaire used in a lighting system illustrated in FIG. 1.

FIG. 8 illustrates a complete automated luminaire 12 as may be used in a lighting system such as that illustrated in FIG. 1. Lenses 34 are visible along with second baffle 36 and compartments 38.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions, and alterations can be made hereto without departing from the spirit and scope of the disclosure.

What is claimed is:

1. A luminaire, comprising:

a plurality of light modules, each having a light source at a proximal end, an exit aperture at a distal end, and a light enclosure covering the light source;

a first light shield, comprising a plurality of first apertures corresponding to the plurality of light modules, each first aperture fitting around a corresponding light module, the first light shield configured to reduce light spill from the light enclosures of the plurality of light modules toward the distal ends of the plurality of light modules;

a first baffle forming sides of a plurality of first shielding compartments corresponding to the plurality of light modules;

a second light shield, comprising a plurality of second apertures corresponding to the plurality of light modules, each second aperture fitting around a corresponding light module, the second light shield coupled to a proximal end of the first baffle, the exit aperture of each light module located in a corresponding first shielding compartment, the second light shield configured to reduce light spill from the first shielding compartments toward the proximal ends of the plurality of light modules;

a plurality of output lenses corresponding to the plurality of first shielding compartments, the plurality of output lenses coupled to a distal end of the first baffle, the edges of each lens coated with a light absorbing coating; and a second baffle forming sides of a plurality of second shielding compartments corresponding to the plurality of output lenses, a proximal end of the second baffle coupled to the plurality of output lenses.

2. The luminaire of claim 1, wherein one or more of the light shields or baffles comprise a non-reflective coating.

3. The luminaire of claim 1, wherein all of the light shields or baffles comprise a non-reflective coating.

4. The luminaire of claim 1, wherein one or more of the plurality of output lenses comprises a plurality of optical elements.

5. The luminaire of claim 4, wherein the plurality of optical elements are configured to alter a relationship to each other.

6. The luminaire of claim 1, wherein the light source comprises a plurality of light emitting diode (LED) dies, each die emitting light of a differing color.

7. The luminaire of claim 6, wherein the light source comprises four LED dies, emitting red, green, blue, and white light, respectively.

8. The luminaire of claim 6, wherein the light module further comprises a light guide optically coupled to the light source, the light guide configured to homogenize and conduct the light emitted by the LED dies to the exit aperture.

9. The luminaire of claim 8, wherein the light guide operates by total internal reflection.

10. The luminaire of claim 8, wherein the light guide tapers so that an entrance aperture of the light guide is smaller than the exit aperture.

11. The luminaire of claim 8, wherein the light guide is contained within an opaque protective sleeve.

* * * * *